US008701216B1

(12) United States Patent
Evans

(10) Patent No.: US 8,701,216 B1
(45) Date of Patent: Apr. 22, 2014

(54) GRIP-IT GOLF METHOD

(71) Applicant: Larry J. Evans, Dade City, FL (US)

(72) Inventor: Larry J. Evans, Dade City, FL (US)

( * ) Notice: Subject to any disclaimer, the term of this patent is extended or adjusted under 35 U.S.C. 154(b) by 0 days.

(21) Appl. No.: 13/897,376

(22) Filed: May 18, 2013

Related U.S. Application Data

(63) Continuation-in-part of application No. 13/408,242, filed on Feb. 29, 2012, now abandoned.

(51) Int. Cl.
*A41D 19/015* (2006.01)

(52) U.S. Cl.
USPC ..... 2/161.2

(58) Field of Classification Search
USPC ..... 2/161.2, 161.3, 161.4, 912, 917, 910
See application file for complete search history.

(56) References Cited

U.S. PATENT DOCUMENTS 3,428,962 A * 2/1969 Slimovitz ..... 2/48
3,624,686 A * 11/1971 Beals ..... 434/98
4,403,366 A * 9/1983 Lucke ..... 15/209.1
4,532,656 A * 8/1985 Suzuki ..... 2/247
4,625,862 A * 12/1986 Clayton ..... 206/315.3
4,984,684 A * 1/1991 Conner et al. ..... 206/315.3
5,119,979 A * 6/1992 Kallman ..... 224/250
5,517,696 A * 5/1996 Krugler ..... 2/250
5,771,523 A * 6/1998 Rudolph ..... 15/209.1
6,115,872 A * 9/2000 Welsh ..... 15/209.1
6,546,599 B2 * 4/2003 Pelt et al. ..... 24/3.1
6,694,575 B1 * 2/2004 Martin ..... 24/306
D532,606 S * 11/2006 Ogonosky ..... D3/329
8,032,951 B1 * 10/2011 Nestberg et al. ..... 2/247
8,245,362 B2 * 8/2012 Blevins ..... 24/298
2002/0138953 A1 * 10/2002 Passafiume ..... 24/306
2003/0029006 A1 * 2/2003 Pelt et al. ..... 24/303
2006/0005335 A1 * 1/2006 Ortega et al. ..... 15/118
2006/0086629 A1 * 4/2006 Cacioppo, Jr. ..... 206/289
2006/0151562 A1 * 7/2006 Moor ..... 224/660
2007/0075106 A1 * 4/2007 Meeh ..... 224/274
2007/0267454 A1 * 11/2007 Baiz ..... 224/901.8
2008/0083131 A1 * 4/2008 Wess ..... 34/239
2009/0082126 A1 * 3/2009 Harrison ..... 473/282
2009/0178175 A1 * 7/2009 McCrary ..... 2/161.6
2010/0064485 A1 * 3/2010 Blevins ..... 24/306

* cited by examiner

*Primary Examiner* — Danny Worrell

(57) ABSTRACT

A grip-it golf method for releasably supporting a golf glove and for maintaining the golf glove in a readily accessible location consists of providing a golf glove, a supporting member, a primary connector, and a supplemental connector, then coupling the primary connector to a recipient member and finally coupling the supplemental connector to the recipient member.

1 Claim, 4 Drawing Sheets

FIG. 5
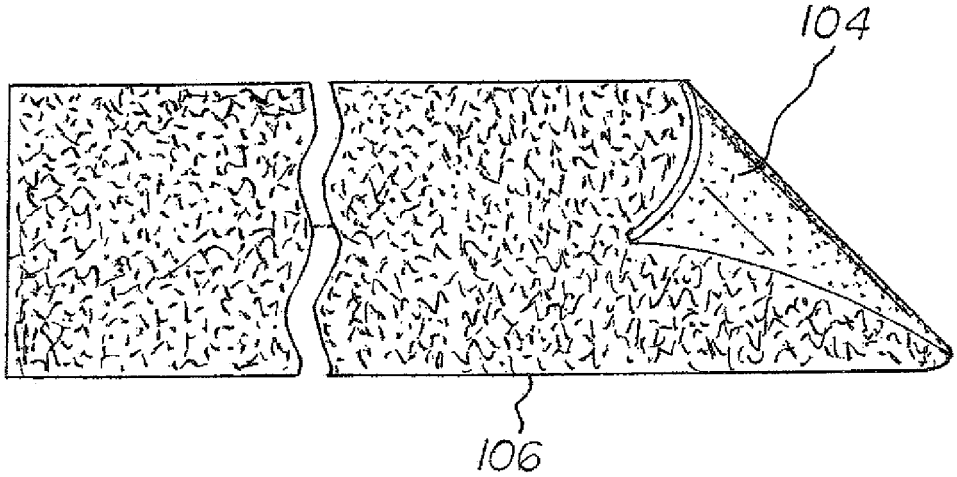
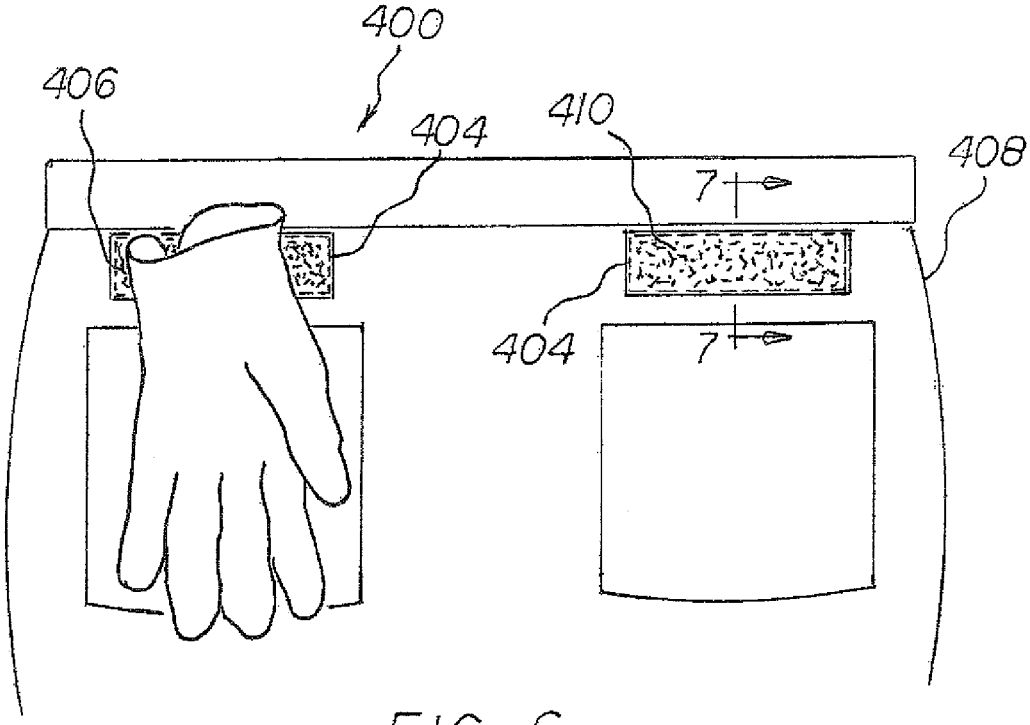
FIG. 6

FIG. 7
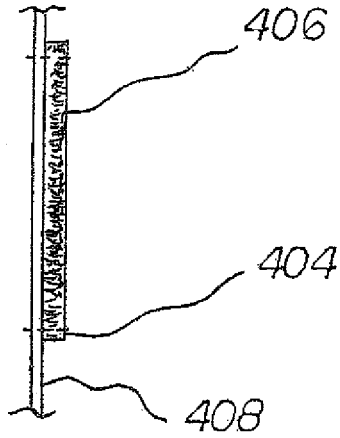
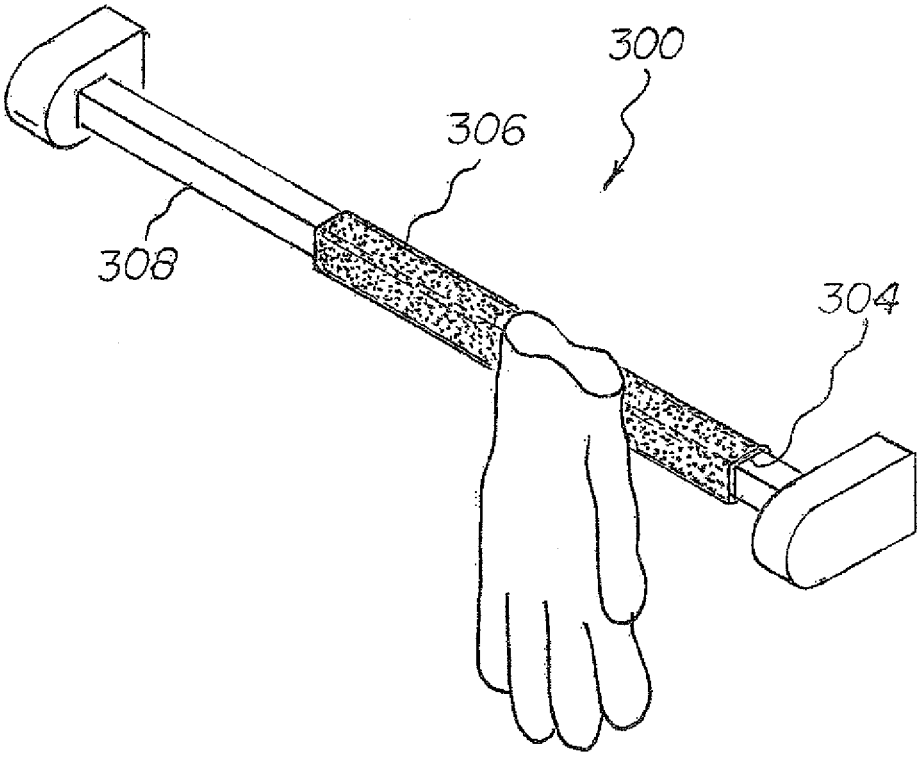
FIG. 8

GRIP-IT GOLF METHOD

RELATED APPLICATION

The present invention is a continuation-in-part of U.S. patent application Ser. No. 13/408,242 filed Feb. 29, 2012 entitled Grip-It Golf System, the subject matter of which application is incorporated herein by reference.

BACKGROUND OF THE INVENTION

Field of the Invention

The present invention relates to a grip-it golf method and more particularly pertains to releasably supporting a golf glove and for maintaining the golf glove in a readily accessible location, the supporting and the maintaining being done in a safe, convenient and economical manner.

SUMMARY OF THE INVENTION

In view of the disadvantages inherent in the known types of golf methods of known designs and configurations now present in the prior art, the present invention provides an improved grip-it golf system. As such, the general purpose of the present invention, which will be described subsequently in greater detail, is to provide a new and improved grip-it golf system and method which has all the advantages of the prior art and none of the disadvantages.

To attain this, the present invention essentially comprises a grip-it golf method for releasably supporting a golf glove and for maintaining the golf glove in a readily accessible location. The supporting and the maintaining are done in a safe, convenient and economical manner.

The first step of the method is providing a golf glove having a hand covering section positionable over the fingers and palm of a golfer, the golf glove having a strap section positionable adjacent to a wrist of the golfer.

The next step is providing a supporting member.

The next step is providing a rectangular primary connector having a linear top edge and a parallel linear bottom edge separated by a height. The primary connector has linear parallel side edges separated by a width. The primary connector has an exposed upper surface and a parallel lower surface separated by a thickness. The primary connector is fabricated of a flexible, essentially inextensible fabric and has a hook and loop fastener on the exposed upper surface.

The next step is coupling the primary connector to a recipient member.

The next step is providing a supplemental connector fabricated of a flexible, essentially inextensible fabric, and having a hook and loop fastener.

The final step is coupling the supplemental connector to the recipient member for releasably coupling the golf glove with respect to the recipient member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved grip-it golf system which has all of the advantages of the prior art golf systems of known designs and configurations and none of the disadvantages.

It is another object of the present invention to provide a new and improved grip-it golf system and method which may be easily and efficiently manufactured and marketed.

It is further object of the present invention to provide a new and improved grip-it golf system and method which is of durable and reliable constructions.

An even further object of the present invention is to provide a new and improved grip-it golf system and method which is susceptible of a low cost of manufacture with regard to both materials and labor, and which accordingly is then susceptible of low prices of sale to the consuming public, thereby making such grip-it golf system economically available to the buying public.

Lastly, it is an object of the present invention to provide a grip-it golf system and method for releasably supporting a golf glove and for maintaining the golf club in a readily accessible location, the supporting and the maintaining being done in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3, 4, 5 and 8 are perspective illustrations of alternate embodiments, adhesive embodiments, of the invention.

FIG. 6 is a perspective illustration of another alternate embodiment, a stitched embodiment, of the invention.

FIG. 7 is a cross sectional view taken along line 7-7 of FIG. 6.

The same reference numerals refer to the same parts throughout the various Figures.

DESCRIPTION OF THE PREFERRED EMBODIMENT

Figure 1:
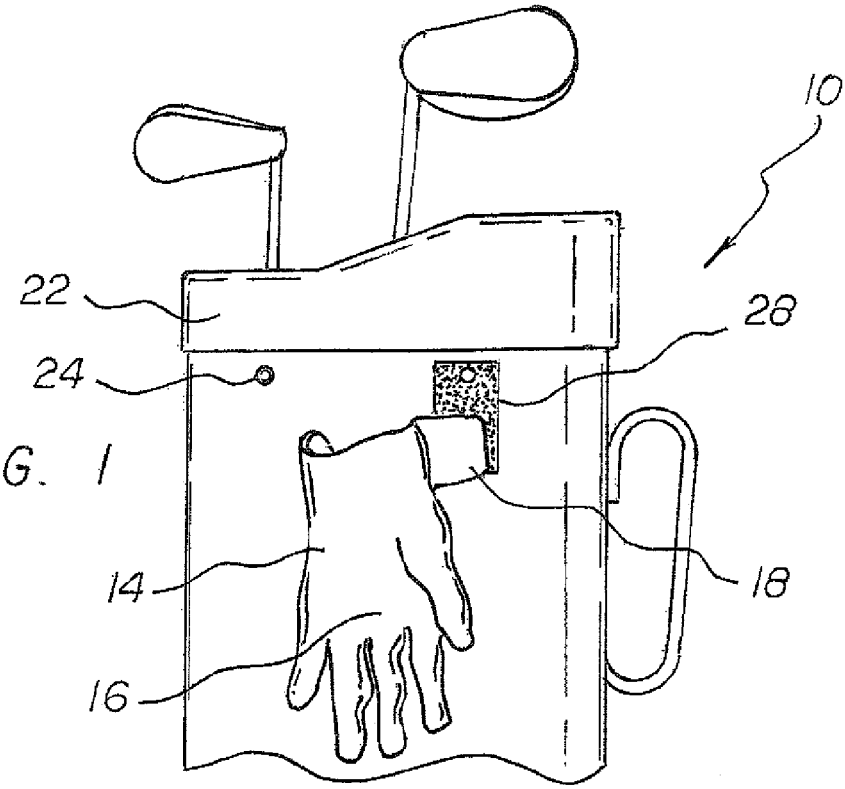
FIG. 1 is a perspective illustration of a grip it golf glove system constructed in accordance with the principles of the present invention.
Figure 2:
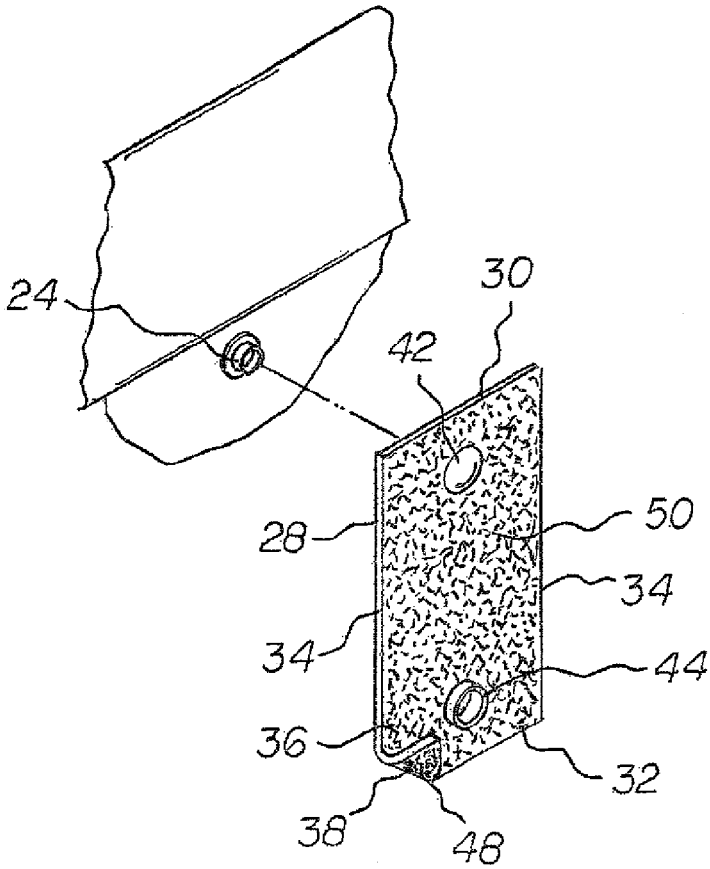
FIG. 2 is an exploded perspective illustration of a portion of the system shown in FIG. 1.

With reference now to the drawings, and in particular to FIG. 1 thereof, the embodiments of the new and improved grip-it golf system and method embodying the principles and concepts of the present invention and generally designated by the reference numeral 10 will be described.

The present invention, the grip-it golf system 10 is comprised of a plurality of components. Such components in their broadest context include a flexible connector, a fastener and a patch of a hook and loop fastener. Such components are individually configured and correlated with respect to each other so as to attain the desired objective.

First provided is a golf glove 14. The golf glove has a hand covering section 16. The hand covering section is positionable over the fingers and palm of a wearer. The golf glove has a strap section 18. The strap section is positionable adjacent to a wrist of the wearer.

A golf bag 22 is provided. The golf bag has an upper peripheral area. The upper peripheral area has a plurality of male snap fasteners 24. The male snap fasteners project outwardly from the upper peripheral area.

A rectangular connector 28 is provided next. The connector has a linear top edge 30. The connector has a parallel linear bottom edge 32. The top and bottom edges are separated by a length of between 1.5 and 2.5 inches. The connector has linear parallel side edges 34. The side edges are separated by a width of between 0.5 and 1.5 inches. The connector has an upper surface 36. The connector has a parallel lower surface 38. The upper and lower surfaces separated by a thickness. The connector is fabricated of a flexible, essentially inextensible fabric.

Further provided is a first female snap fastener 42. The first female snap fastener extends from the upper surface adjacent to the top edge. A second female snap fastener 44 is provided. The second female snap fastener extends from the lower surface adjacent to the bottom edge. One of the female snap fasteners is releasably coupled to one of the male snap fastener. In this manner the connector will hang from a user-selected area of the golf bag.

Provided last is a first patch 48 of a hook and loop fastener. The first patch is secured to the first surface of the connector. The first patch is of a hook orientation. A second patch 50 of a hook and loop fastener is provided. The second patch is secured to the second surface of the connector. The second patch is of a loop orientation. A third patch 52 of a hook and loop fastener is provided. The third patch is secured to the strap of the glove. The third patch is adapted to releasably couple to a preselected one of the patches of the connector.

Figure 3:
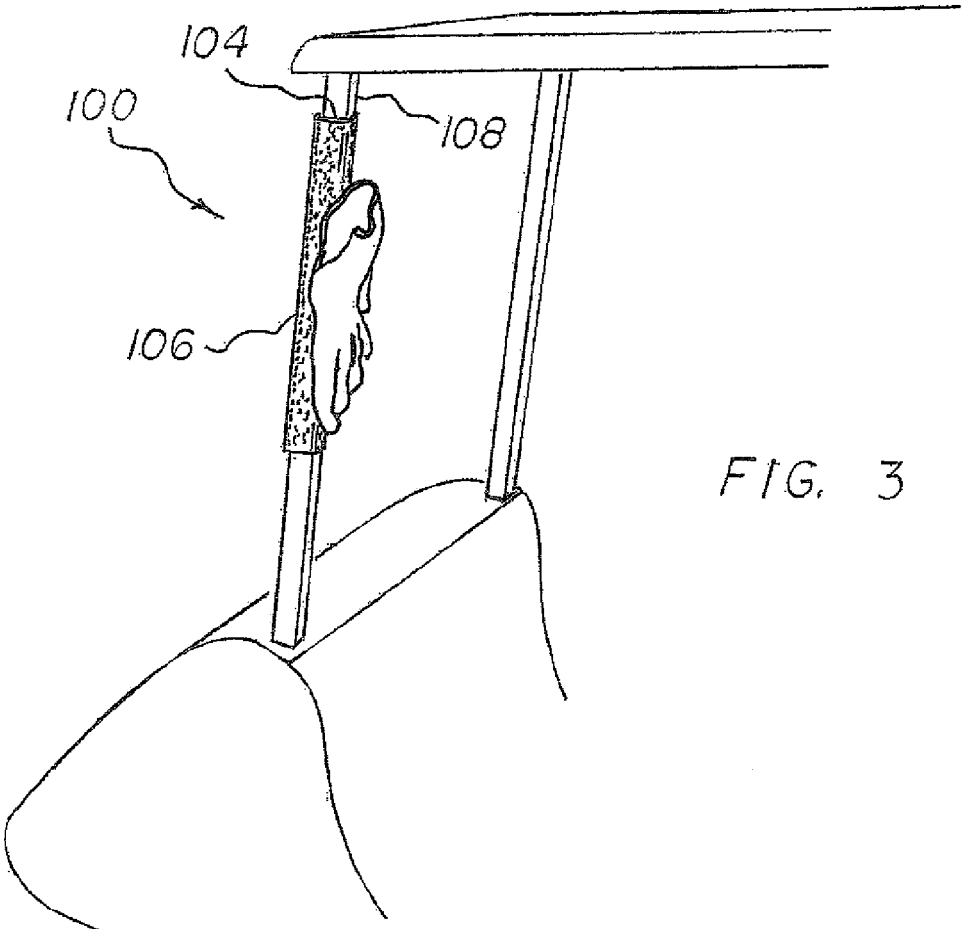

An alternate embodiment 100 of the present invention is provided. The fastener is an adhesive 104. A connector 106 is provided. The fastener is provided on the lower surface of the connector and the recipient surface. The recipient surface is a support post 108 of a golf cart. Note FIG. 3.

Figure 4:
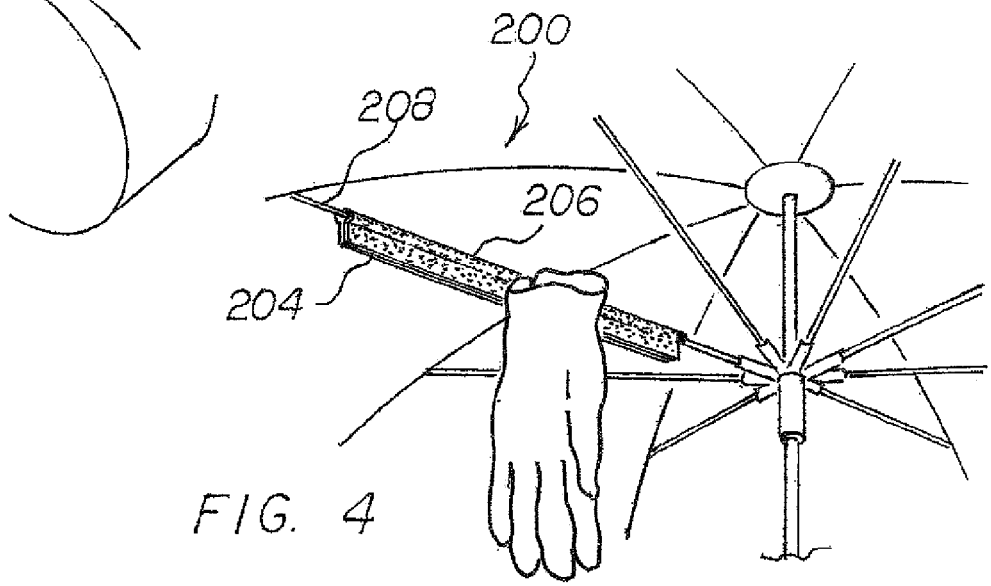

Another alternate embodiment 200 of the present invention is provided. The fastener is an adhesive 204. A connector 206 is provided. The adhesive is provided on the lower surface of the connector and the recipient surface. The recipient surface is a rib 208 of an umbrella. Note FIG. 4.

Another alternate embodiment 300 of the present invention is provided. The fastener is an adhesive 304. A connector 306 is provided. The adhesive is provided on the lower surface of the connector and the recipient surface. The recipient surface is a towel rack 308. Note FIG. 8.

An alternate embodiment 400 of the present invention is provided. The fastener is stitching 404. A connector 406 is provided. The stitching is provided through the connector adjacent the periphery and the recipient surface. The recipient surface is trousers 408. The system includes a supplemental connector 410. The connector and the supplemental connector have a hook fastener and a loop fastener respectively. Note FIGS. 6 and 7.

The final and the preferred embodiment of the invention is a grip-it golf method for releasably supporting a golf glove and for maintaining the golf glove in a readily accessible location. The supporting and the maintaining are done in a safe, convenient and economical manner. The method comprises the following steps.

The first step in the method is providing a golf glove having a hand covering section positionable over the fingers and palm of a golfer, the golf glove having a strap section positionable adjacent to a wrist of the golfer.

The next step is providing trousers for being worn by the golfer, the trousers having an upper waist band area and rear left and right pockets there beneath, the trousers having left and right attachment zones above the left and right pockets beneath the upper waist band area.

The next step is providing two similarly configured primary connectors, the primary connectors each being rectangular with a linear top edge and a parallel linear bottom edge separated by a height of from one inch to two inches, the primary connectors each having linear parallel side edges separated by a width of from four inches to eight inches, the primary connectors each having an exposed upper surface and a parallel lower surface separated by a thickness, the primary connectors each being fabricated of a flexible, essentially inextensible fabric with a hook and loop fastener on the exposed upper surface.

The next step is stitching the primary connectors to the trousers by stitches extending through the trousers in the left and right attachment zones and through the primary connectors adjacent the top and bottom and side edges.

The next step is providing a supplemental connector being fabricated of a flexible, essentially inextensible, fabric and having a hook and loop fastener.

The next step is stitching the supplemental connector to the golf glove by stitches extending through the golf glove and through the supplemental connector for releasably coupling the golf glove with respect to the trousers in a location to cover one of the rear left and right pockets.

The final step is providing a yardage book removably positioned in one of the pockets, the yardage book being covered by the golf glove when the golfer utilizing the system is on a putting green and is not wearing the golf glove, the yardage book being uncovered and accessible by the golfer when the golfer utilizing the system is on a fairway and wearing the golf glove.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A grip-it golf method for releasably supporting a golf glove and for maintaining the golf glove in a readily accessible location, the supporting and the maintaining being done in a safe, convenient and economical manner, the method comprising, in combination, the steps of:

providing a golf glove having a hand covering section positionable over the fingers and palm of a golfer, the golf glove having a strap section positionable adjacent to a wrist of the golfer;

providing trousers for being worn by the golfer, the trousers having an upper waist band area and rear left and right pockets there beneath, the trousers having left and right attachment zones above the left and right pockets beneath the upper waist band area;

providing two similarly configured primary connectors, the primary connectors each being rectangular with a linear top edge and a parallel linear bottom edge separated by a height of from one inch to two inches, the primary connectors each having linear parallel side edges separated by a width of from four inches to eight inches, the primary connectors each having an exposed upper surface and a parallel lower surface separated by a thickness, the primary connectors each being fabricated of a flexible, essentially inextensible fabric with a hook and loop fastener on the exposed upper surface;

stitching the primary connectors to the trousers by stitches extending through the trousers in the left and right attachment zones and through the primary connectors adjacent the top and bottom and side edges;

providing a supplemental connector being fabricated of a flexible fabric and having a hook and loop fastener;

stitching the supplemental connector to the golf glove by stitches extending through the golf glove and through the supplemental connector for releasably coupling the golf glove with respect to the trousers in a location to cover one of the pockets;

providing a yardage book removably positioned in one of the pockets, the yardage book being covered by the golf glove when the golfer utilizing the system is on a putting green and is not wearing the golf glove, the yardage book being uncovered and accessible by the golfer when the golfer utilizing the system is on a fairway and is wearing the golf glove.

* * * * *